United States Patent [19]

Cantrell et al.

[11] Patent Number: 4,515,170

[45] Date of Patent: May 7, 1985

[54] VENTILATED MOUTHPIECE FOR A SMOKING ARTICLE

[75] Inventors: Daniel V. Cantrell; Robert A. Sanford, both of Prospect, Ky.

[73] Assignee: Brown & Williamson Tobacco Corporation, Louisville, Ky.

[21] Appl. No.: 492,978

[22] Filed: May 9, 1983

[51] Int. Cl.[3] ..... A24D 3/04

[52] U.S. Cl. ..... 131/336; 131/339

[58] Field of Search ..... 131/336, 339, 340, 361, 131/341

[56] References Cited

U.S. PATENT DOCUMENTS 4,256,122 3/1981 Johnson ..... 131/336

FOREIGN PATENT DOCUMENTS 2849904 5/1979 Fed. Rep. of Germany ..... 131/336

*Primary Examiner*—V. Millin

*Attorney, Agent, or Firm*—Charles G. Lamb

[57] ABSTRACT

A ventilated mouthpiece adapted to be attached to a smoking article, such as a cigarette, includes a generally cylindrical core member of smoke and air impermeable material having a smoke inlet end and a mouth end. The smoke inlet end is to be placed in juxtaposition to one end of the tobacco column of the cigarette. The core member is formed with a plurality of smoke flow capillaries therethrough for delivering unfiltered smoke from the tobacco column to the mouth end of the core member, and a plurality of ventilation air flow channels which receive ambient ventilation air and delivers the ventilation air to the mouth end of the core member. The smoke outlets from each of the smoke flow capillaries at the mouth end of the core member are located in close proximity to and are radially situated inwardly of the mouth end of the core member from the air outlets from the air flow channels.

16 Claims, 12 Drawing Figures

VENTILATED MOUTHPIECE FOR A SMOKING ARTICLE

BACKGROUND OF THE INVENTION (1) Field of the Invention

The present invention relates to smoke diluting devices, and more particularly to a mouthpiece for a cigarette, or the like, which delivers unfiltered smoke and ventilation air to the smoker's mouth in separate streams, causing dilution of the smoke within the smoker's mouth and turbulence to the smoke.

(2) Description of the Prior Art

It is well known in the art to add filters to cigarettes wherein the filters are provided with ventilating means to bring ambient air into the filter to dilute the smoke flowing through the filter. The dilution of the smoke reduces the quantity of smoke particulates as well as gas phase components which are delivered to the mouth of the smoker.

Another method for diluting the smoke is to make the tobacco column wrapper material permeable to air which allows for the introduction of air along the entire length of the tobacco column where it mixes with the smoke stream passing through the tobacco column thereby diluting the smoke.

Yet another method is to provide generally longitudinal ventilation air grooves in the periphery of a filter which grooves are open to the mouth end of the filter. The filtered smoke leaving the mouth end of the filter is mixed with the ventilation air exiting the ventilation air grooves in the smoker's mouth whereat the smoke is diluted. Examples of cigarette filters having grooves for the introduction of ventilating air into the filtering end are shown in the following Patents: U.S. Pat. No. 3,577,995; U.S. Pat. No. 3,572,347; U.S. Pat. No. 3,490,461; U.S. Pat. No. 1,718,122; U.S. Pat. No. 3,788,330; U.S. Pat. No. 3,773,053; U.S. Pat. No. 3,752,165; U.S. Pat. No, 3,638,661; U.S. Pat. No. 3,608,561; U.S. Pat. No. 3,910,288; and, U.S. Pat. No. 4,256,122.

It has also been proposed to provide a cigarette filter which delivers a combination of air diluted filtered smoke and undiluted, unfiltered smoke to the smoker's mouth. One such cigarette filter is shown in U.S. Pat. No. 3,860,011 as being formed of a hollow filter including a rigid non-deformable tube defining a smoke passage for delivering unfiltered smoke to the smoker's mouth, a concentric layer of filter material surrounding the tube, and a perforated outer wrap for the passage of air into the layer of filter material.

Devices for diluting unfiltered smoke with ventilating air before the smoke enters a smoker's mouth are also known. One example of such a device is shown in U.S. Pat. No. 3,552,399. The device, therein referred to as a filter for homogenizing air and smoke has a blind ended, longitudinal central axial passageway open to either the smoker's mouth or a filter element, a plurality of longitudinal passageways surrounding and extending parallel to the central passageway, and transverse passageways interconnecting the longitudinal passageways and central passageway with each other and with the ambient air. As the cirgarette to which the device is attached is smoked, smoke and ambient air traverses the longitudinal and central passageways wherein the smoke and air are mixed before delivery to the smoker's mouth.

Devices are also known for delivering unfiltered smoke and ventilation air to the smoker's mouth. For example, U.S. Pat. No. 4,023,576 shows a cigarette with a hollow mouthpiece which defines a smoke chamber. The smoke chamber is separated from the tobacco column by two spaced apart baffle plates which define a curved path which the smoke must traverse before entering the smoke chamber. The mouth end of the chamber is closed by a wall having a central orifice for the flow of smoke out of the smoke chamber into the smoker's mouth. The exterior surface of the mouthpiece is provided with longitudinal grooves which cooperate with an overlaying perforated tipping paper to define flow paths for ventilating air. When a smoker draws on the mouthpiece, undiluted, unfiltered smoke is drawn from the tobacco column into the smoke chamber and through the outlet orifice centrally of the mouthpiece and into the smoker's mouth. At the same time, ventilation air is drawn in through the tipping paper and longitudinal grooves to mix with the undiluted smoke within the smoker's mouth.

SUMMARY OF THE INVENTION

The present invention advantageously provides a straight forward arrangement for a ventilated mouthpiece for a cigarette for lowering tar by ventilation. The present invention also provides a mouthpiece for a cigarette which enhances the perceived taste of a cigarette while lowering tar by ventilation. The present invention even further provides a mouthpiece of the class described which is adapted to produce a pressure drop and, therefore, draw effort which is less than the draw effort of a conventional filtered cigarette.

More particularly, the present invention provides a ventilated mouthpiece for a cigarette comprising a generally cylindrical core member fabricated of an air and smoke impermeable material, the core member having the smoke inlet end and mouth end; means defining a plurality of ventilating air flow channels extending along at least a portion of the core member, the air flow channels being open to the mouth end of the core member providing for the flow of only ventilating air therethrough to the outside of the core member at the mouth end; means providing for the flow of only ventilating air into the ventilating air flow channels; means defining a plurality of smoke flow capillaries extending through the core member, each smoke flow capillary being open to the smoke inlet end of the core member and open to the mouth end of the core member providing for the flow therethrough of only smoke from the inlet end of the core member to the outside of the core member at the mouth end; and, each of the openings of the smoke flow capillaries at the mouth end of the core member being adjacent to, and spaced inwardly generally radially of the core member from an opening of the ventilating air flow channels at the mouth end of the core member.

It is to be understood that the description of the following examples of the present invention given hereinafter are not by way of limitation and various modifications will occur to those skilled in the art upon reading the disclosure set forth hereinafter.

BRIEF DESCRIPTION OF THE DRAWINGS

The various features and advantages of the present invention will become clear upon reference to the following description and accompanying drawings wherein like numerals refer to like parts throughout, and in which.

DESCRIPTION OF THE PREFERRED EMBODIMENTS

Figure 1:
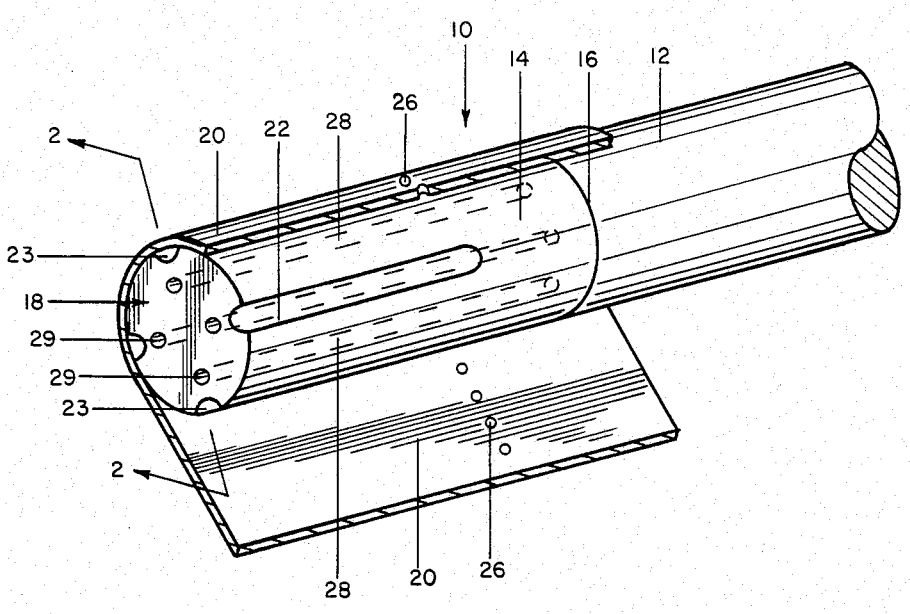
FIG. 1 is a perspective view of one advantageous embodiment of a mouthpiece of the present invention, attached to a cigarette tobacco column.
Figure 2:
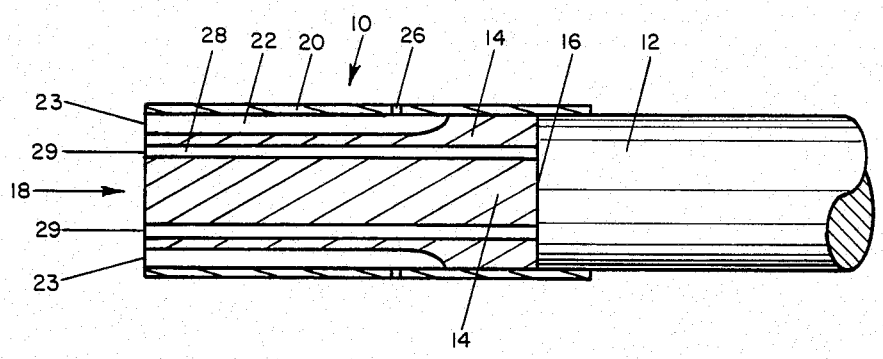
FIG. 2 is a longitudinal cross-sectional view of the mouthpiece of FIG. 1 as viewed in the direction of arrows 2—2 in FIG. 1.

FIGS. 1 and 2 show one advantageous embodiment of a ventilated mouthpiece, generally denoted as the number 10, of the present invention attached to a cigarette tobacco column 12. The mouthpiece 10 is shown as comprising a generally cylindrical core member 14, fabricated of an air and smoke impermeable material, and having a smoke inlet end 16 and a mouth end 18. The core member 14 is coaxially located at one end of the tobacco column 12 with the inlet end 16 in juxtaposition to one end of the tobacco column 12. The core member 14 is shown as being attached to the tobacco column 12 by air permeable tipping material 20 which circumscribes the core member 14 and overlaps a portion of the tobacco column 12. In FIG. 1, the tipping material 20 is shown partially unwrapped to show details of the core member 14.

The core member 14 includes a plurality of ventilating air channels 22 extending along at least a portion of the core member 14. The ventilating air channels 22 are shown as being generally longitudinally extending grooves formed in the peripheral surface of the core member 14. While as illustrated for the sake of clearness in the drawings, the air channels 22 comprise four grooves equally spaced about the circumference of the core member. It has been found that the advantageous results of the present invention are obtained using from three to seven air grooves 22. Each groove is open, as designated by the number 23, to the mouth end 18 of the core member 14 and extends therefrom in a generally longitudinal direction of the core member 14 for a distance less than the length of the core member. The air channels or grooves 22 deliver ventilating air therethrough to the outside of the core member at the mouth end 18. The flow of only ventilating air into the ventilating air channels 22 is shown as being accomplished by means of the air permeable tipping material 20. For the sake of illustration, the air permeability is provided by means of small perforations 26 formed through the tipping material communicating with the ventilating air channels 22. Alternately, the tipping material 20 can be fabricated of a porous material.

The core member 14 further comprises a plurality of smoke flow capillaries 28 extending through the core member 14 from the smoke inlet end 16 to the mouth end 18. Each smoke flow capillary is open at one end to the smoke inlet end 16 of the core member 14 and open, as designated by the number 29, at its opposite end to the mouth end 18 of the core member 14, thus, providing for the flow of only smoke through the capillaries 28 from the inlet end 16 to the outside of the core member 14 at the mouth end 18. The plurality of smoke flow capillaries 28 are shown as being equal in number to the number of air flow channels 22 with the openings 29 of the smoke flow capillaries 28 at the mouth end 18 of the core member 14 located in a circular array about the longitudinal axis of the core member 14. The outlet 29 of each smoke flow capillary 28 is closely adjacent to, in generally radial alignment with and generally radially, inwardly spaced from an air outlet 23 of a different one of the air flow channels 22. Preferably, the air channels 22 and smoke capillaries 28 are appropriately sized numbered to provide a total air to smoke flow ratio of about 3 to 1. Thus, in the embodiment shown in FIGS. 1 and 2, with the number of air channels 22 being equal to the number of smoke capillaries 28, the cross-sectional area of each of the air flow channels 22 is about three times the cross-sectional area of each of the smoke capillaries 28. It has been determined that the cross-sectional area of each smoke capillary 28 should be on the order of from about 0.00125 $cm^2$ to about 0.00385 $cm^2$. The spacing between an air outlet 23 of an air flow channel 22 and the smoke outlet 29 of a smoke capillary 28 adjacent thereto is as close as practically possible still leaving a portion of air and smoke permeable material between them.

It is contemplated that the mouth end 18 of the core member 14 can be recessed. This can be accomplished by extending the tipping material 20 longitudinally of the core member 14 beyond the mouth end 18 of the core member 14.

It is also contemplated that some of the smoke flow capillaries 28 be of smaller diameter than other smoke flow capillaries 28 to provide, what is termed in the industry, a programmed smoke flow to the mouth end 18 of the core member 14. As the cigarette is smoked, the smoke flow capillaries 28 become blocked reducing the smoke flow therethrough. By varying the diameters of some of the smoke flow capillaries 28, the rate at which the various capillaries become progressively blocked can be adjusted to provide a gradual, programmed reduction in the amount of smoke delivered to the mouth end 18 of the core member 14 as the cigarette is smoked.

When a smoker draws on the ventilated mouthpiece 10, ventilating air is drawn into the air channels 22 through the perforations 26 in the tipping material 20. The air flows along the ventilating air channels 22 and is discharged through the open outlets 23 at the mouth end 18 and into the smoker's mouth. Concurrently, smoke from the tobacco column 12 is drawn into the smoke flow capillaries 28 through their openings at the smoke inlet end 16 of the core member 14 and is delivered, unfiltered, to the mouth end 18 of the core member 14 through the outlet openings 29 of the smoke capillaries 28 at the mouth end 18 of the core member 14 and into the smoker's mouth closely adjacent to the ventilation air flow and exiting the air channels 22. The ventilating air from the air channels 22 co-mingles with the unfiltered smoke from the capillaries 28 diluting the smoke and causing turbulence. The air and smoke leaving the mouth end 18 of the core member 14 near the periphery of the mouth end results in an enhanced perception of taste to the smoker because the smoke is dispensed over a larger area of the oral cavity, thus stimulating more of the smoker's "taste buds".

Figure 3:
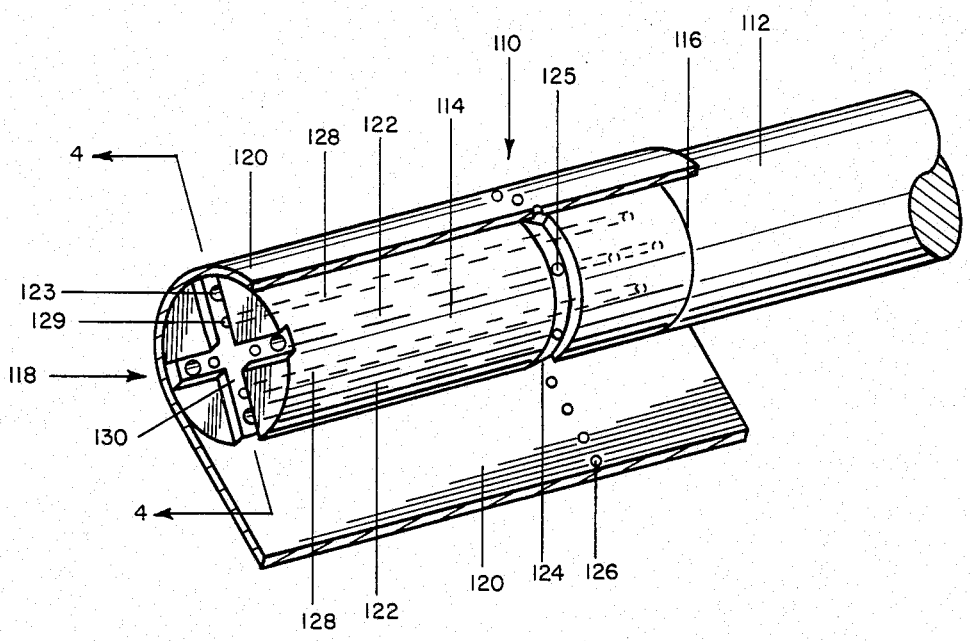
FIG. 3 is a perspective view of another advantageous embodiment of a mouthpiece of the present invention attached to a cigarette tobacco column.
Figure 4:
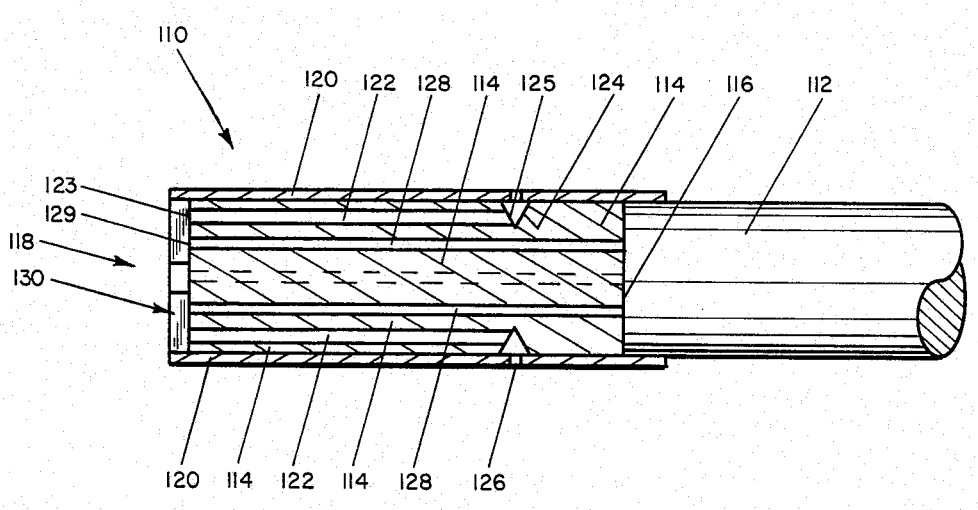
FIG. 4 is a longitudinal cross-sectional view of the mouthpiece of FIG. 3 as viewed in the direction of arrows 4—4 in FIG. 3.

Now with reference to FIGS. 3 and 4, there is illustrated another advantageous embodiment of a ventilated mouthpiece, generally denoted as the number 110, of the present invention attached to a cigarette tobacco column 112. The mouthpiece 110 is shown as comprising a generally cylindrical core member 114, fabricated of an air and smoke impermeable material, and having a smoke inlet end 116 and a mouth end 118. The core member 114 is coaxially located at one end of the tobacco column 112 with the inlet end 116 in juxtaposition to the end of the tobacco column 112. The core member 114 is shown as being attached to the tobacco column 112 by air permeable tipping material 120 which circumscribes the core member 114 and overlaps a portion of the tobacco column 112. In FIG. 3 the tipping material 120 is shown as partially unwrapped to illustrate details of the core member 114.

The core member 114 includes a plurality of ventilating air channels 122 extending along at least a portion of the core member 114. The ventilating air channels 122 are shown as being generally longitudinally extending closed ducts formed within the core member 114 and open, as designated by the number 123, to the mouth end 118 of the core member 114 for delivering ventilating air therethrough to the outside of the core member at the mouth end 118. As shown, the air channels 122 comprise four ducts equally spaced from each other in a circular array with their open outlets 123 being spaced inwardly of the peripheral surface of the core member 114. However, it should be understood that advantageous results are obtained using from three to seven air channels 122. The flow of only ventilating air into the ventilating air channels 122 is accomplished by means of an annular ventilating air accumulation groove 124 formed in the perimeter of the core member 114. Each of the ventilating air channels 122 has one end, designated as the number 125, open to the annular air accumulation groove 124 to establish air flow communication between the annular groove 124 and the air channels 122. The openings 125 of the air channels 122 in the annular groove 124 are preferably equally spaced about the groove 124. The flow of ventilating air from the ambient into the ventilating air accumulation groove 124 is shown as being accomplished by means of the air permeable tipping material 120. For example, the air permeability is provided by means of small perforations 126 formed through the tipping material communicating with the ventilating air accumulation groove 124. The tipping material 120 could be fabricated of a porous material thereby eliminating the air flow perforations 126.

The core member 114 further comprises a plurality of smoke flow capillaries 128 extending through the core member 114 from the smoke inlet end 116 to the mouth end 118 of the core member 114. Each smoke flow capillary is open at one end to end 116 and open, as designated by the number 129, at its opposite end to the mouth end 118 of the core member, thus, providing for the flow of only smoke through the capillaries 128 from the inlet end 116 to the outside of the core member 114 at the mouth end 118. The plurality of smoke flow capillaries 128 are shown, by way of example, as being equal in number to the number of air flow channels 122 with the openings 129 of the smoke flow capillaries 128 at the mouth end 118 of the core member 114 located in a circular array about the longitudinal axis of the core member 114. The outlet openings 129 of each smoke flow capillary 128 is closely adjacent to, in generally radial alignment with the generally radially inwardly spaced from an air outlet opening 123 of a different one of the air flow channels 122. Preferably, the air flow channels 122 and smoke flow capillaries are sized and numbered to provide a total air to smoke ratio of about 3 to 1. Thus, for the reason that in the illustration of FIGS. 3 and 4 the number of smoke flow capillaries 128 is equal to the number of air channels 122 the cross-sectional area of each air flow channel 122 is about three times the cross-sectional area of each of the smoke capillaries 128. The spacing between an air outlet 123 of an air flow channel 122 and the smoke outlet 129 of a smoke capillary 128 adjacent thereto is as close as practically possible still leaving a partition of smoke and air impermeable material between them. Furthermore, it has been determined that advantageous results are obtained if the cross-sectional area of each of the smoke capillaries is from about 0.00125 $cm^2$ to about 0.00385 $cm^2$.

As with the embodiment of FIGS. 1 and 2, it is also contemplated that the smoke flow capillaries 128 be of various diameters to provide a programmed smoke flow therethrough.

As illustrated, the smoke outlet openings 129 and the ventilating air outlet openings 123 are recessed inwardly of the mouth end 118. In the embodiment of FIGS. 3 and 4, the recessing of the smoke outlet openings 129 and the ventilating air outlet openings 123 is accomplished by forming cavities 130 into which the smoke and ventilating air are discharged. The number of cavities 130 is equal in number to the number of aligned, grouped air and smoke outlet openings, and a different ground pair of air and smoke outlet openings discharge air and smoke in separate streams into different ones of the cavities 130. Each cavity 130 extends from the perimeter of the core member 114 generally radially of the core member toward the center thereof. As shown, each cavity 130 is open to the core mouth end 118 and all of the cavities 130 are in mutual flow communication at the proximate center of the core member 118.

When a smoker draws on the ventilated mouthpiece 110, ventilating air is drawn into the annular air accumulation groove 124 through the perforations 126 in the tipping material 120. The air flows from the air accumulation groove 124 into ventilation air channels 122 through the inlet openings 125, and is discharged through the outlet openings 123 at the mouth end 118 into the cavities 130. The annular accumulation groove 124 functions in the manner of a plenum to control the pressure drop of the ventilating air and provide an even distribution of ventilating air flowing into the ventilating channels 122. At the same time, smoke from the tobacco column 112 is drawn through the smoke flow capillaries 128 and is discharged through the outlet openings 129 into the open cavities 130 at the mouth end 118 of the core member 114. The ventilating air from the air channels 122 co-mingles with the unfiltered smoke from the capillaries 128 diluting the smoke and causing turbulence. The air and smoke leaving the mouth end 118 of the core member 114 near the periphery of the mouth end results in an enhanced perception of taste to the smoker.

Figure 5:
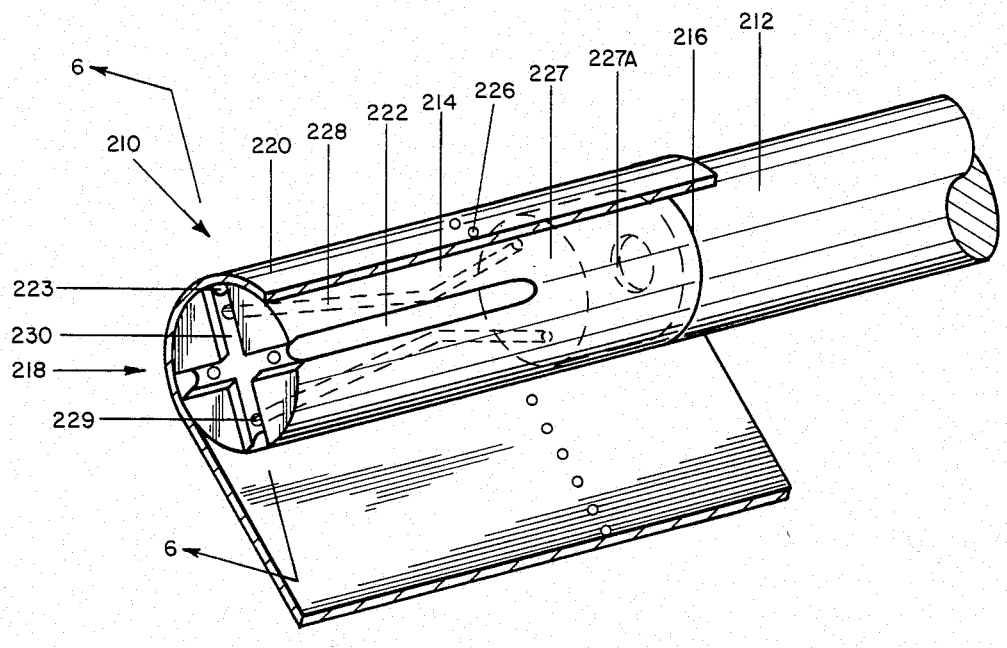
FIG. 5 is a perspective view of a further advantageous embodiment of a mouthpiece of the present invention attached to a cigarette tobacco column.
Figure 6:
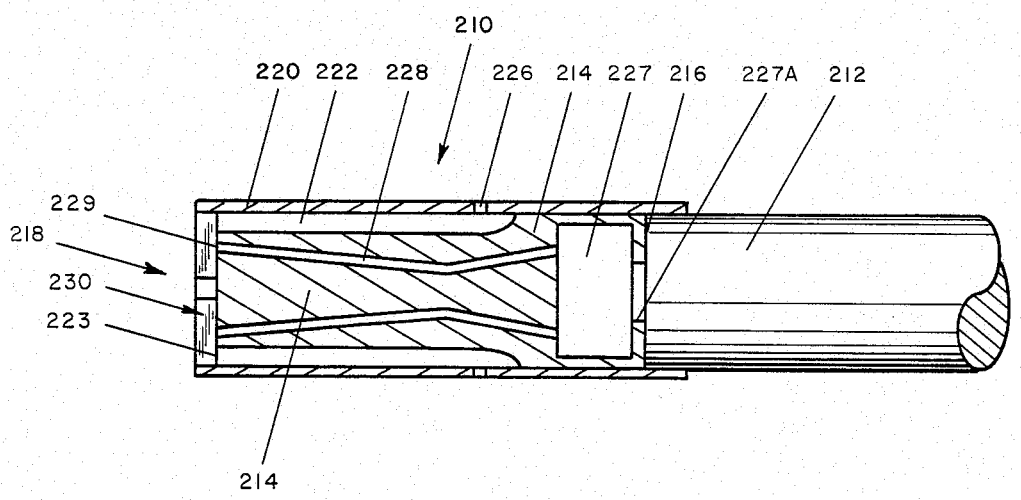
FIG. 6 is a longitudinal cross-sectional view of the mouthpiece of FIG. 5 as viewed in the direction of arrows 6—6 in FIG. 5.

FIGS. 5 and 6 illustrate a further advantageous embodiment of a ventilated mouthpiece, generally denoted as the number 210, of the present invention attached to a cigarette tobacco column 212. The mouthpiece 210 is illustrated as comprising a generally cylindrical core member 214, fabricated of an air and smoke impermeable material and having a smoke inlet end 216 and a mouth end 218. The core member 214 is coaxially located at one end of the tobacco column 212 with the inlet end 216 in juxtaposition to the end of the tobacco column 212. The core member 214 is shown as being attached to the tobacco column 212 by air permeable tipping material 220 which circumscribes the core member 214 and overlaps a portion of the tobacco column 212. The tipping material 220 is shown as partially unwrapped to show details of the core member 214.

The core member 214 includes a plurality of ventilating air channels 222 extending through at least a portion of the core member 214. The ventilating air channels 222 are shown as being generally longitudinally extending grooves formed in the peripheral surface of the core member 214. As illustrated, the air channels 222 comprise four grooves equally spaced about the circumference of the core member although from three to seven air channels 222 can advantageously be employed. Each groove is open, as designated by the number 223, to the mouth end 218 of the core member 214 and extends therefrom in a generally longitudinal direction of the core member 214, for a distance less than the length of the core member. The air channels or grooves 222 deliver ventilating air therethrough to the outside of the core member at the mouth end 218. The flow of only ventilating air into the ventilating channels 222 is shown as being accomplished by means of the air permeable tipping material 220. By way of example, the air permeability is provided by means of small perforations 226 formed through the tipping material communicating with the ventilating air channels 222. Alternately, the tipping material can be fabricated of a porous material.

The core member 214 is shown as further comprising a smoke plenum chamber 227 formed at the linlet end 216 of the core member 214 open to the tobacco column 212 by means of, for example, a port 227A. A plurality of smoke flow capillaries 228 extends through the core member 214 from the smoke plenum chamber 227 at the smoke inlet end 216 to the mouth end 218 of the core member. Each smoke flow capillary 228 is open to the smoke plenum chamber 227 and open, as designated by the number 229, to the mouth end 218 of the core member, thus, providing for the flow of only unfiltered smoke through the capillaries 228 from the smoke plenum chamber 227 to the outside of the core member 214 at the mouth end 218. The number of smoke flow capillaries 228 is shown as being equal to the number of ventilating air channels 222 with the outlet openings 229 of the smoke flow capillaries 228 at the mouth end 218 of the core member disposed in a circular array about the longitudinal axis of the core member. The outlet opening 229 of each smoke flow capillary 228 is closely adjacent to, are illustrated as being in generally radial alignment with and generally radially, inwardly spaced from an air outlet opening 223 of a different one of the air flow channels 222. Preferably, the air to smoke ratio should be on the order of about 3 to 1 and, therefore, for the reason that in the illustrated embodiment the number of smoke capillaries 228 and air channels 222 are equal, the cross-sectional area of each of the air flow channels 222 is about three times the cross-sectional area of each of the smoke flow capillaries 228 with the cross-sectional area of each of the smoke capillaries 228 being on the order of from about 0.00125 $cm^2$ to about 0.00385 $cm^2$. The spacing between an air outlet openings 223 and a smoke outlet openings 229 adjacent thereto is as close as practically possible still leaving a portion of smoke and air impermeable material between them. As shown, the portion of the smoke flow capillaries 228 immediately upstream of the smoke outlet openings 229 have their longitudinal axes oriented at an angle to the longitudinal axis of the core member such that the portions of the capillaries 228 immediately upstream of the outlet openings angle outwardly toward the perimeter of the core member in a direction toward the mouth end 218. That is, the longitudinal axes of the capillaries 228 immediately upstream of the outlet openings diverge in the direction of the smoke flow therethrough. As illustrated, the portion of the smoke capillaries 228 immediately downstream of the smoke plenum chamber 227 have their longitudinal axes oriented to angle toward the longitudinal axis of the core member in a direction from the smoke plenum chamber 227 toward the mouth end of the core member.

As shown, the open smoke outlet openings 229 of the smoke capillaries 228 and the ventilating air outlet openings 223 of the air channels 222 are recessed inwardly of the core mouth end 218. The recessing of the smoke outlet openings and air outlet openings is accomplished by forming cavities 230 into which the smoke and ventilating air are discharged. The number of cavities 230 is equal to the number of grouped air and smoke outlet openings, and a different grouped pair of air and smoke outlet openings discharge air and smoke in separate streams into a different cavity 230. Each cavity 230 extends from the perimeter of the core member 214 generally radially of the core member toward the center thereof. As shown, each cavity 230 is open to the core mouth end 218 and all of the cavities 230 are in mutual flow communication at the proximate center of the core member 214.

When a smoker draws on the ventilated mouthpiece 210, ventilating air is drawn into the air channels 222 through the perforations 226 in the tipping material 220. The air flows through the ventilating air channels 222, and is discharged through the outlet openings 223 at the mouth end 218 into the cavities 230. Simultaneously, smoke from the tobacco column 212 is drawn into the smoke plenum chamber 227 through port 227A at the inlet end 216 of the core member 214 and flows, unfiltered, through the capillaries 228, and is discharged into the cavities 230 at the mouth end 218 of the core member through the outlet openings 229 of the capillaries. The radial outward angle of the smoke capillaries 228 upstream of the outlet openings 229 directs the flow of smoke exiting therefrom in a generally radially outward direction of the core member impinging into the flow of ventilating air issuing from the outlet openings 223 of the air flow channels 222 diluting the smoke, creating turbulence therein and carrying the diluted smoke generally radially outwardly of the mouthpiece into close proximity to the smoker's "taste buds".

Figure 7:
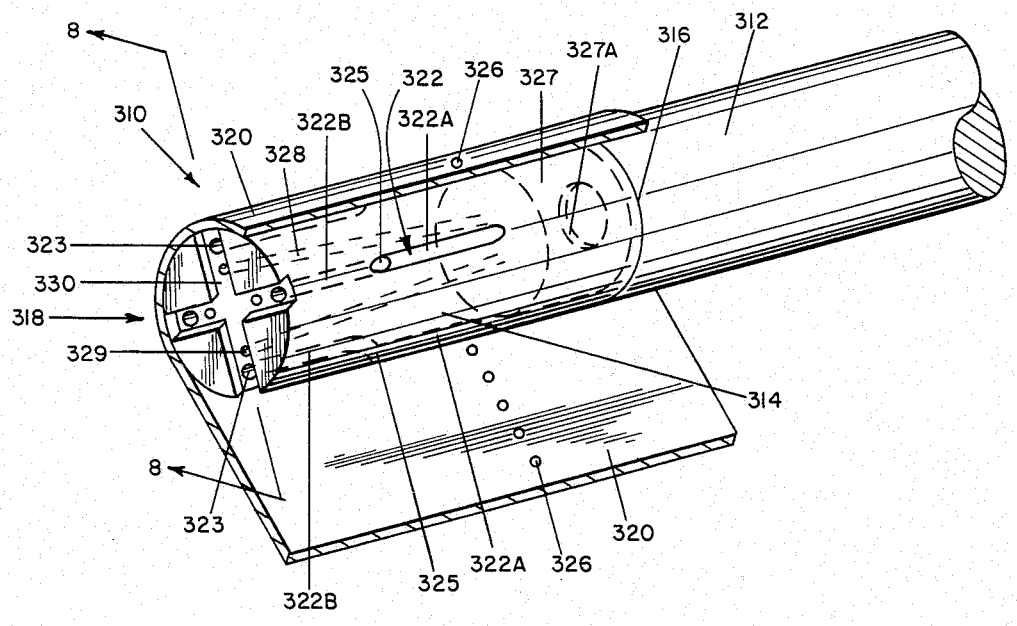
FIG. 7 is a perspective view of yet a further advantageous embodiment of a mouthpiece of the present invention attached to a cigarette tobacco column.
Figure 8:
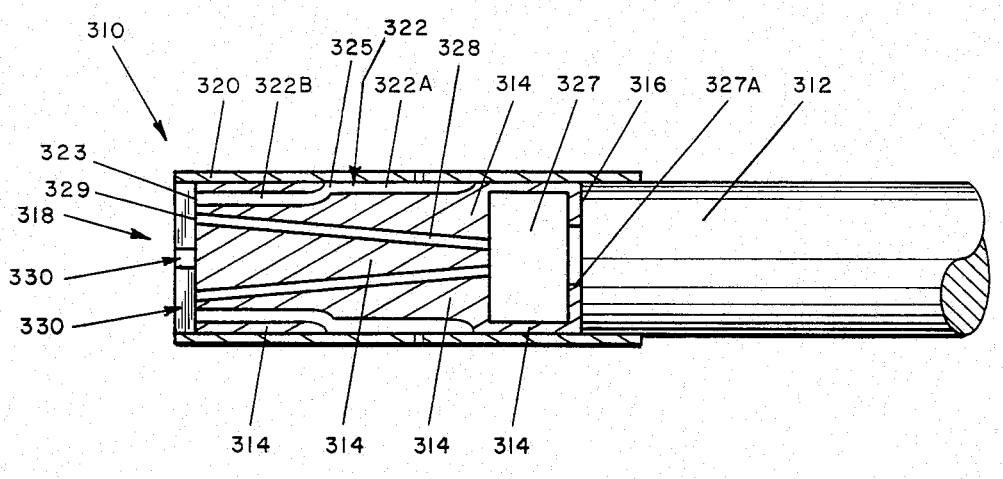
FIG. 8 is a longitudinal cross-sectional view of the mouthpiece of FIG. 7 as viewed in the direction of arrows 8—8 in FIG. 7.

FIGS. 7 and 8 show yet another advantageous embodiment of a ventilated mouthpiece, generally denoted as the numeral 310, of the present invention attached to a cigarette tobacco column 312. The mouthpiece 310 is illustrated as comprising a generally cylindrical core member 314, fabricated of an air and smoke impermeable material and having a smoke inlet end 316 and a mouth end 318. The core member 314 is coaxially located at one end of the tobacco column 312 with the inlet end 316 in juxtaposition to one end of the tobacco column 312. The core member 314 is shown as being attached to the tobacco column 312 by air permeable tipping material 320 which circumscribes the core member 314 and overlaps a portion of the tobacco column 312. The tipping material 320 is shown as partially unwrapped to show details of the core member 314.

The core member 314 includes a plurality of ventilating air channels 322 extending generally longitudinally along at least a portion of the core member 314. While FIG. 7 shows four ventilating air channels 322 equally spaced apart about the circumference of the core member 314 preferably from three to seven air channels 322 are incorporated in the core member 314. Each ventilating air channel comprises a groove portion 322A and a coaxially aligned closed duct portion 322B. The groove portion 322A is formed in the peripheral surface of the core member 314 extending longitudinally of the core member from a location short of the core member inlet end 316 to a location between the core member inlet end 316 and core member mouth end 318 whereat it merges with the coaxially aligned, closed duct portion 322B which is formed within the core member and extends from the location of merger to the core member mouth end 318. The closed duct portion 322B of each air channel 322 is open, as designated by the number 323, to the core member mouth end 318 and open, as designated by the number 325, to the groove portion 322A. The outlet opening 323 of each duct portion 322B is spaced inwardly of the peripheral surface of the core member 314. The flow of only ventilating air into the ventilating air channels 322 is shown as being accomplished by means of the air permeable tipping material 320. By way of example, the air permeability is provided by means of small perforations 326 formed through the tipping material communicating with the groove potions 322A of the ventilating air channels 322. Alternatively, the tipping material can be fabricated of a porous material.

The core member 314 is shown as further comprising a smoke plenum chamber 327 formed at the inlet end 316 of the core member 314 open to the tobacco column 312 by means of, for example, a port 327A. A plurality of smoke flow capillaries 328 extend through the core member 314 from the smoke plenum chamber 327 at the smoke inlet end 316 to the mouth end 318 of the core member 314. Each smoke flow capillary 328 is open to the smoke plenum chamber 327 and open, as designated by the number 329, to the mouth end 318 of the core member, thus, providing for the flow of unfiltered smoke through the capillaries 328 from the smoke plenum chamber 327 to the outside of the core member 314 at the mouth end 318. As shown, the number of smoke flow capillaries 328 is equal to the number of ventilating air channels 322. The outlet openings 329 of the smoke flow capillaries 328 at the mouth end 318 of the core member are disposed in a circular array about the longitudinal axes of the core member. The outlet opening 329 of the each smoke flow capillary 328 is closely adjacent to, in generally radial alignment with and generally radially, inwardly spaced from an air outlet opening 323 of a different one of the air flow channels 322. The air to smoke ratio is preferably about 3 to 1 and, therefore, in the illustrated embodiment of FIGS. 7 and 8, the cross-sectional area of each of the air flow channels 322 is about three times the cross-sectional area of each of the smoke flow capillaries 328. As with the other embodiments discussed above, the cross-sectional area of each smoke capillary 328 is preferably from about 0.00125 $cm^2$ to about 0.00385 $cm^2$. The spacing between an air outlet opening 323 and a smoke outlet opening 329 adjacent thereto is as close as possible still leaving a partition of air and smoke impermeable material between them. As shown, the smoke flow capillaries are oriented with their longitudinal axes at an angle to the longitudinal axes of the core member 314 such that they angle outwardly toward the perimeter of the core member in a direction toward the mouth and 318.

As illustrated, the smoke outlet openings 329 of the smoke capillaries 328 and the ventilating air outlet openings 323 of the air channels 322 are recessed inwardly of the core mouth end 318. The recessing of the smoke outlet openings and air outlet openings is accomplished by forming cavities 330 into which the smoke and ventilating air are discharged. The number of cavities 330 is equal to the number of grouped air and smoke outlet openings, and a different grouped pair of air and smoke outlet openings discharge air and smoke in separate streams into different ones of the cavities 330. Each cavity 330 extends from the perimeter of the core member 314 generally radially of the core member toward the center thereof. As shown, each cavity 330 is open to the core mouth end 318 and all of the cavities 330 are in mutual flow communication at the proximate center of the core member 314.

When a smoker draws on the ventilated mouthpiece 310, ventilating air is drawn into the air channels 322 through the perforations 326 in the tipping material 320. The air flows through the ventilating air channels 322, and is discharged through the outlet openings 323 at the mouth end 318 into the cavities 330. Simultaneously, smoke from the tobacco column 312 is drawn into the smoke plenum chamber 327 through the port 327A at the inlet end 316 of the core member 314 and flows, unfiltered through the capillaries 328, and is discharged into the cavities 330 at the core member mouth end 318 through the outlet openings 329 of the capillaries. The radial outward angle of the smoke capillaries 328 directs the flow of smoke exiting therefrom in a generally radially outward direction of the core member impinging into the flow of ventilating air issuing from the outlet openings 323 of the air flow channels 322 diluting the smoke, creating turbulence therein and carrying the diluted smoke generally radially outward of the mouthpiece in close proximity to the smoker's "taste buds".

Figure 9:
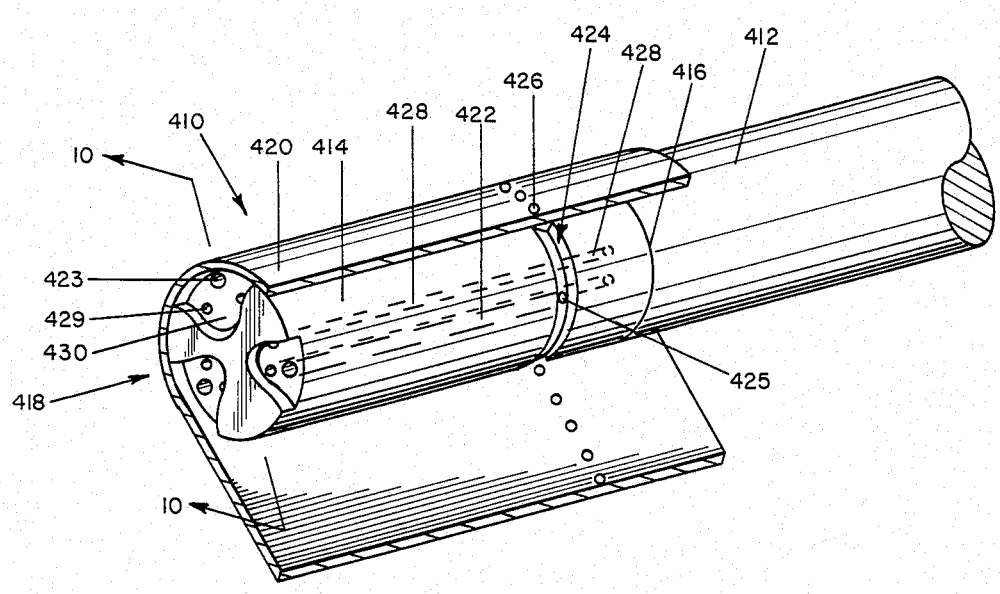
FIG. 9 is a perspective view of yet a further advantageous embodiment of a mouthpiece of the present invention attached to a cigarette tobacco column.
Figure 10:
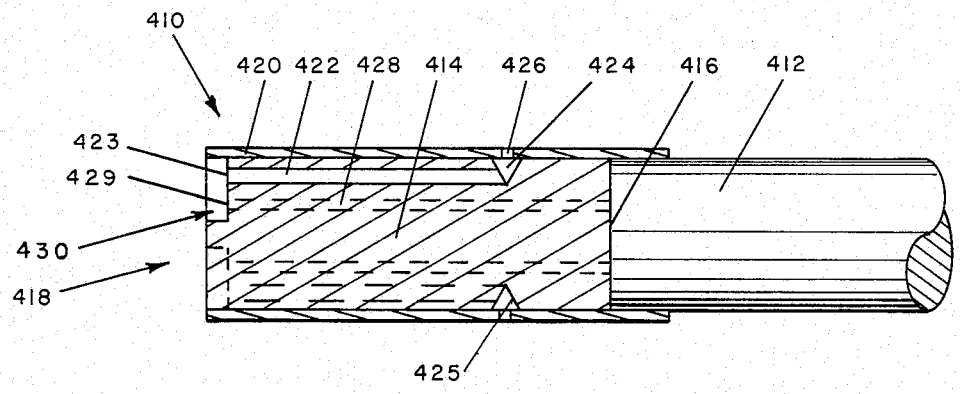
FIG. 10 is a longitudinal cross-sectional view of the mouthpiece of FIG. 9 as viewed in the direction of arrows 10—10 in FIG. 9.

FIGS. 9 and 10 show yet a further advantageous embodiment of a ventilated mouthpiece, generally denoted as the number 410, of the present invention attached to a cigarette tobacco column 412. The mouthpiece 410 is illustrated as comprising a generally cylindrical core member 414, fabricated of an air and smoke impermeable material and having a smoke inlet end 416 and a mouth end 418. The core member 414 is coaxially located at one end of the tobacco column 412 with the inlet end 416 in juxtaposition to one end of the tobacco column 412. The core member 414 is shown as being attached to the tobacco column 412 by air permeable tipping material 420 which circumscribes the core member 414 and overlaps a portion of the tobacco column 412. The tipping material 420 is shown as partially unwrapped to show details of the core member 414.

The core member 414 includes a plurality of ventilating air channels 422 extending generally longitudinally along at least a portion of the core member 414. The ventilating air channels 422 are shown as being generally longitudinally extending closed ducts formed within the core member 414 and open, as designated by the number 423, to the mouth end 418 of the core member 414 for delivering ventilating air therethrough to the outside of the core member at the mouth end 418. As shown, the air channels 422 comprise three ducts equally spaced from each other in a circular array with their open outlets 423 being spaced inwardly of the peripheral surface of the core member 414. The flow of only ventilating air into the ventilating air channels 422 is accomplished by means an annular ventilating air accumulation groove 424 formed in the perimeter of the core member 414. Each of the ventilating air channels 422 has one end, designated by the number 425, open to the annular air accumulation groove 424 to establish air flow communication between the annular groove 424 and the air channels 422. The openings 425 of the air channels 422 in the annular groove 424 are preferably equally spaced about the groove 424. The flow of ventilating air from the ambient into the ventilating air accumulation groove 424 is shown as being accomplished by means of the air permeable tipping material. For example, the air permeability is provided by means of small perforations 426 formed through the tipping material communicating with the ventilating air accumulation groove 424. The tipping material 420 could be fabricated of a porous material thereby eliminating the air flow perforation 426.

The core member 414 further comprises a plurality of smoke flow capillaries 428 extending through the core member 414 from the smoke inlet end 416 to the mouth end 418 of the core member 414. Each smoke flow capillary is open at one end to the inlet end 416 and open, as designated by the number 429, at its opposite end to the mouth end 418 of the core member, thus, providing for the flow of only smoke through the smoke capillaries 428 from the inlet end 416 to the outside of the core member 414 at the mouth end 418. The plurality of smoke flow capillaries 428 are shown, by way of example, as being double in number to the number of air channels 422, and more specifically six in number. The smoke capillaries 428 are grouped in pairs with the outlet openings 429 of each pair of smoke capillaries being located closely adjacent the outlet opening 423 of a different one of the air channels 422. The outlet openings 429 of each pair of smoke capillaries 428 are spaced to either side of and generally radially of the core member 414 inwardly of the adjacent outlet openings 423 of the air channel 422. The air channels 422 and smoke capillaries 428 preferably provide approximately a 3 to 1 air to smoke ratio. Furthermore, it has been determined that advantageous results are obtained if the cross-sectional area of each of the smoke capillaries is from about 0.00125 $cm^2$ to about 0.00385 $cm^2$.

As illustrated, the smoke outlet openings 429 and the ventilating air outlet openings 423 are recessed inwardly of the core member mouth end 418. In the embodiment of FIGS. 9 and 10, the recessing is accomplished by forming cavities 430 into which the smoke and ventilating air are discharged. The number of cavities 430 is equal in number to the number of grouped smoke and air outlet openings. In the embodiment of FIGS. 9 and 10, there are three such cavities 430, and a different one of the grouped air and smoke outlet openings discharge air and smoke in separate streams into different ones of the cavities 430.

When a smoker draws on the ventilated mouthpiece 410, ventilated air is drawn into the annular air accumulation groove 424 through the perforations 426 in the tipping material 420. The air flows from the air accumulation groove 424 into the ventilation air channels 422 through the inlet openings 426, and is discharged through the outlet openings 423 at the mouth end 418 into the cavities 430. The annular acccumulation groove 424 functions in the manner of a plenum to control the pressure drop of the ventilating air and provides an even distribution of ventilating air flowing into the air channels 422. Concurrently, smoke from the tobacco column 412 is drawn through the smoke capillaries 428 and is discharged through the outlet openings 429 into the open cavities 430 at the mouth end 418 of the core member 414. The ventilating air from the air channels 422 co-mingles with the unfiltered smoke from the capillaries 428 diluting the smoke and causing turbulence. The air and smoke leaving the mouth end 418 of the core member 414 near the periphery of the mouth end results in an enhanced perception of taste to the smoker.

Figure 11:
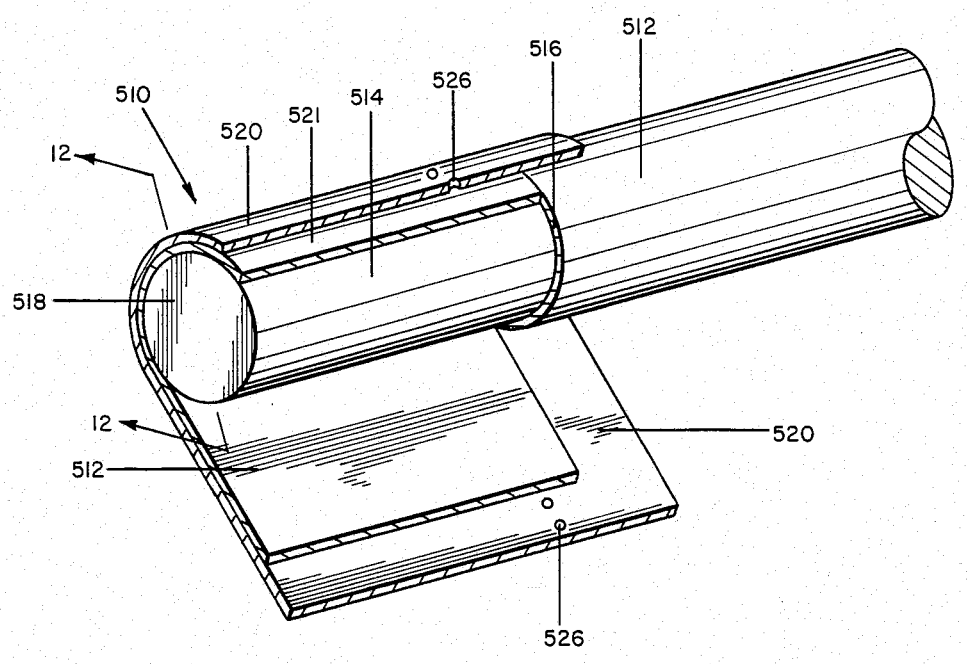
FIG. 11 is a perspective view of a mouthpiece of the present invention circumscribed by an air permeable wrapper and attached to a cigarette tobacco column by air permeable tipping material; and, FIG. 12 is a longitudinal cross-sectional view of the cigarette assembly of FIG. 11 as viewed in the direction of arrows 11—11 in FIG. 11.
Figure 12:
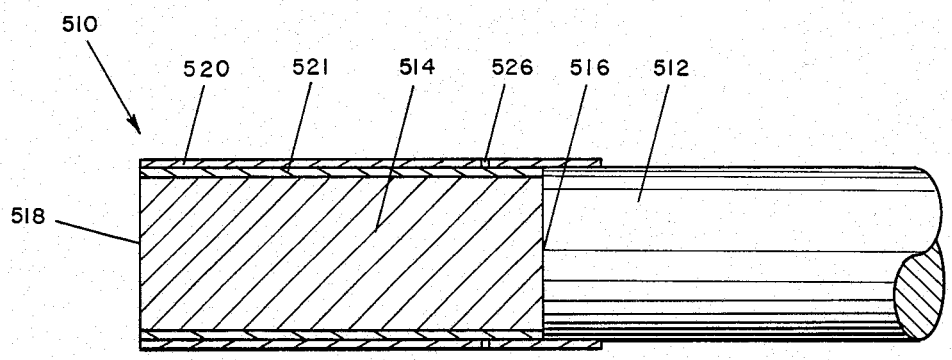

With reference to FIGS. 11 and 12, there is shown a ventilated mouthpiece, generally denoted as the number 510, attached to a cigarette tobacco column 512. The mouthpiece 510 is shown as comprising a generally cylindrical core number 514 fabricated of an air and smoke impermeable material and having a smoke inlet end 516 and a mouth end 518. It should be clearly understood that the core member 514 is generic to all of the above discussed core members, i.e., any of the core members can be considered to be the core member 514. Therefore, no details of the smoke capillaries and air flow channels are shown in FIGS. 11 and 12, nor will they be discussed hereinafter. The core member 514 is coaxially located at one end of the tobacco column 512 with the inlet end 516 in juxtaposition to the end of the tobacco column 512. It is foreseeable that the core member 514 will be fabricated of a relatively hard, smooth plastic material to which it may be difficult to adhesively attach a tipping material 520. As illustrated, to overcome this potential problem, the core member 514 is circumscribed with an air permeable wrapper 521, and the wrapped core member is attached to the tobacco column 512 by the air permeable tipping material 520 which circumscribes the wrapped core member and overlaps a portion of the tobacco column 512. The tipping material is adhesively secured to the wrapper 521 and the overlapped portion of the tobacco column 512. In FIG. 11, both the air permeable wrapper 521 and air permeable tipping material 520 are shown in a partially unwrapped position to more clearly show their relationship with the core member 514. In order to compensate for the thickness of the air permeable wrapper 521, it is contemplated that the diameter of the core member 514 be smaller than the diameter of the tobacco column 512 by an amount substantially equal to twice the thickness of the air permeable wrapper 521 so that the perimeter of the wrapped core member 514 is generally coextensive with the perimeter of the tobacco column 512.

The foregoing detailed description is given primarily for clearness of understanding and no unnecessary limitations are to be understood therefrom for modifications will become obvious to those skilled in the art upon reading this disclosure and can be made without departing from the spirit of the invention or scope of the appended claims.

What is claimed is:

1. A ventilated mouthpiece for a cigarette, comprising:

a generally cylindrical core member fabricated entirely out of an air and smoke impermeable material, the core member having a smoke inlet end and mouth end;

means defining a plurality of ventilating air flow channels extending along at least a portion of the core member, the air flow channels being open to the mouth end of the core member providing for the flow of only ventilating air therethrough to the outside of the core member at the mouth end;

means providing for the flow of only ventilating air into the ventilating air flow channels;

means defining a plurality of linear, cylindrically shaped smoke flow capillaries extending through the core member from the smoke inlet end to the mouth end of the core member, each smoke flow capillary being open to the smoke inlet end of the core member and open to the mouth end of the core member providing for the flow therethrough of only smoke from the inlet end of the core member to the outside of the core member at the mouth end; and the openings of the smoke flow capillaries at the mouth end of the core member being spaced inwardly generally radially of the core member from the openings of the ventilating air flow channels at the mouth end of the core member.

2. The mouthpiece defined in claim 1, wherein the means providing for the flow of only ventilating air into the at least one ventilating air flow channel comprises:

means defining an annular groove in the perimeter of the core member, the ventilating air flow channels being in air flow communication with the annular groove; and, means providing for the flow of only ventilating air into the annular groove.

3. The mouthpiece of claim 1, wherein the openings of the plurality of smoke flow capillaries at the mouth end of the core member are recessed inwardly of the mouth end of the mouthpiece; and, the openings of the ventilation air flow channels at the mouth end of the core member are recessed inwardly of the mouth end of the mouthpiece.

4. The mouthpiece of claim 1, wherein at least that portion of smoke flow capillaries upstream of the smoke outlet openings of the smoke flow capillaries are oriented at an angle to the longitudinal axis of the core member outwardly toward the perimeter of the core member in a direction toward the mouth end of the core member for directing the flow of smoke exiting therefrom in a generally radially outward direction of the core member and toward the flow of ventilating air issuing from the air flow channels.

5. The mouthpiece of claim 1, further comprising means defining a plurality of generally radially extending cavities formed in and open to the mouth end of the core member, at least one smoke capillary being in flow communication with each open cavity, and at least one ventilating air channel being in flow communication with each open cavity.

6. The mouthpiece of claim 5, wherein all of the open cavities are in mutual flow communication at the proximate center of the core member.

7. The ventilated mouthpiece of claim 1, further comprising means defining a smoke plenum chamber in the core member; the plurality of smoke flow capillaries being in smoke flow communication with the smoke plenum chamber for receiving smoke therefrom.

8. The ventilated mouthpiece of claim 1, wherein the means providing for the flow of only ventilating air into the ventilating air channels comprises air permeable tipping material circumscribing the core member.

9. The mouthpiece of claim 1, wherein the number of smoke flow capillaries are equal to the number of air flow channels.

10. The mouthpiece of claim 9, wherein each of the openings of the smoke flow capillaries at the mouth end of the core member is in generally radial alignment with a different one of the openings of the ventilating air flow channels at the mouth end of the core member.

11. The mouthpiece of claim 1, wherein the openings of the smoke flow capillaries at the mouth end of the core member are grouped in pairs, and each pair of openings is located adjacently to the openings of a different one of the air channels at the mouth end of the core member.

12. The mouthpiece of claim 1, wherein the air flow channels and the smoke flow capillaries deliver an air to smoke flow ratio of about 3 to 1 at the mouth end of the core member.

13. The mouthpiece of claim 1, wherein each of the smoke flow capillaries has a cross-sectional area of from about 0.00125 $cm^2$ to about 0.00385 $cm^2$.

14. A cigarette comprising:

a tobacco column;

a generally cylindrical core member fabricated entirely out of an air and smoke impermeable materials, the core member having a smoke inlet end and a mouth end, and the core member being coaxially located at one end of the tobacco column with the smoke inlet end in juxtaposition to the end of the tobacco column;

means defining a plurality of ventilating air flow channels through at least a portion of the core member and each having an open air outlet to the mouth end of the core member;

means defining a plurality of linear, cylindrically shaped smoke flow capillaries extending through the core member from the smoke inlet end to the mouth end of the core member and each having an open smoke outlet to the mouth end of the core member;

the openings of the smoke flow capillaries of the mouth end of the core member being spaced inwardly generally radially of the core member from the openings of the ventilating air flow channels at the mouth end of the core member; and, an air permeable tipping material circumscribing the core member overlapping a portion of the tobacco column to attach the core member to the tobacco column.

15. The cigarette of claim 14, wherein the circumscribing tipping material extends longitudinally of the core member beyond the mouth end thereby defining a recessed area at the mouth end of the core member.

16. The cigarette of claim 14, further comprising:

an air permeable wrapper circumscribing the core number; and, the tipping material circumscribing the wrapped core member.

* * * * *